US010487473B2

(12) United States Patent
Asplin

(10) Patent No.: US 10,487,473 B2
(45) Date of Patent: Nov. 26, 2019

(54) WALL LIFTING METHODS

(71) Applicant: Charles L. Asplin, Fargo, ND (US)

(72) Inventor: Charles L. Asplin, Fargo, ND (US)

( * ) Notice: Subject to any disclaimer, the term of this patent is extended or adjusted under 35 U.S.C. 154(b) by 0 days.

(21) Appl. No.: 16/013,261

(22) Filed: Jun. 20, 2018

(65) Prior Publication Data

US 2018/0363268 A1 Dec. 20, 2018

Related U.S. Application Data

(63) Continuation-in-part of application No. 15/628,142, filed on Jun. 20, 2017, now abandoned.

(51) Int. Cl.

| | |
|---|---|
| ***E02D 35/00*** | (2006.01) |
| ***E02D 27/48*** | (2006.01) |
| ***E04G 23/06*** | (2006.01) |

(52) U.S. Cl.

CPC ..... *E02D 35/005* (2013.01); *E02D 27/48* (2013.01); *E04G 23/065* (2013.01)

(58) Field of Classification Search

CPC ..... E01C 23/10; E02D 37/00; E02D 35/00; E02D 35/005; E04G 23/0211; E04G 23/0203; E04G 23/065; E04G 21/163

USPC ..... 52/2.26; 405/264, 266, 267, 269; 404/75–80; 166/285–295

See application file for complete search history.

(56) References Cited

U.S. PATENT DOCUMENTS

| | | | | |
|---|---|---|---|---|
| 1,915,032 A | | 6/1933 | Poulter | |
| 1,943,914 A | | 1/1934 | Fiock | |
| 2,007,457 A | | 7/1935 | Peters | |
| 2,041,266 A | | 5/1936 | Poulter | |
| 2,074,756 A | | 3/1937 | Poulter | |
| 2,853,858 A | * | 9/1958 | Mintz | E02D 3/12 405/266 |
| 4,070,867 A | * | 1/1978 | Cassidy | E02D 5/226 405/230 |

(Continued)

FOREIGN PATENT DOCUMENTS

| | | |
|---|---|---|
| JP | 03047305 | 2/1991 |
| JP | 06146213 | 5/1994 |

(Continued)

OTHER PUBLICATIONS

Foundation Supportworks by Leader, Mud Jacking and Slab Jacking in Springfield, Worcester, Providence, & Cambridge, https://www.leaderfoundationrepair.com/concrete-lifting/mud-jacking.html (last accessed on Sep. 19, 2019) (Year: 2019).*

(Continued)

*Primary Examiner* — Theodore V Adamos
(74) *Attorney, Agent, or Firm* — Hamre, Schumann, Mueller & Larson, P.C.

(57) ABSTRACT

Methods of lifting structures such as a wall of a building. A fluid that is under pressure is injected beneath the base of the wall. The pressure of the injected fluid acts against the base of the wall to lift the wall vertically. In some embodiments, a supplemental lifting force mechanism can be attached to the wall to apply a supplemental lifting force to the wall that acts together with the lifting force applied by the injected fluid. The supplemental lifting force "lightens" the wall, reducing the amount of lifting force required to be applied to the wall by the injected fluid.

10 Claims, 7 Drawing Sheets

(56) References Cited

U.S. PATENT DOCUMENTS

| | | | | | |
|---|---|---|---|---|---|
| 4,194,726 | A | | 3/1980 | Hance | |
| 4,294,141 | A | | 10/1981 | Miller | |
| 4,420,957 | A | | 12/1983 | Weber | |
| 4,466,760 | A | | 8/1984 | Feldsted | |
| 4,495,738 | A | | 1/1985 | Sheber | |
| 4,511,291 | A | | 4/1985 | Quates et al. | |
| 4,567,708 | A | | 2/1986 | Haekkinen | |
| 4,592,679 | A | | 6/1986 | Boiting et al. | |
| 4,646,482 | A | | 3/1987 | Chitjian | |
| 4,787,779 | A | † | 11/1988 | Clark | |
| 4,839,969 | A | | 6/1989 | Hahn | |
| 4,850,752 | A | | 7/1989 | Carey-Yard | |
| 4,878,320 | A | | 11/1989 | Woodson | |
| 4,962,913 | A | | 10/1990 | Stewart | |
| 5,081,799 | A | | 1/1992 | Kirschner et al. | |
| 5,083,402 | A | | 1/1992 | Kirschner et al. | |
| 5,230,185 | A | | 7/1993 | Kirschner et al. | |
| 5,239,788 | A | | 8/1993 | Woodson | |
| 5,325,638 | A | | 7/1994 | Lynn | |
| 5,529,293 | A | | 6/1996 | Haugs | |
| 5,558,474 | A | | 9/1996 | Wildon | |
| 5,561,914 | A | | 10/1996 | Asplin | |
| 5,577,446 | A | | 11/1996 | Perry et al. | |
| 5,722,798 | A | * | 3/1998 | Gregory | B66F 1/025 254/133 R |
| 5,771,557 | A | | 6/1998 | Contrasto | |
| 5,795,108 | A | | 8/1998 | Lightle | |
| 5,860,763 | A | | 1/1999 | Asplin | |
| 5,974,611 | A | | 11/1999 | Casella | |
| 5,979,879 | A | | 11/1999 | Asplin | |
| 5,980,162 | A | * | 11/1999 | McCown | E02D 5/56 405/244 |
| 6,068,425 | A | | 5/2000 | Fershtut | |
| 6,082,708 | A | | 7/2000 | Mullican et al. | |
| 6,558,071 | B1 | | 5/2003 | Sproules | |
| 6,976,804 | B1 | | 12/2005 | Asplin | |
| 7,226,274 | B1 | | 6/2007 | Asplin | |
| 7,421,746 | B1 | | 9/2008 | Cobi | |
| 7,461,997 | B1 | | 12/2008 | Mack, II | |
| 8,092,116 | B1 | | 1/2012 | Asplin | |
| 8,186,907 | B1 | | 5/2012 | Asplin | |
| 8,714,880 | B1 | * | 5/2014 | Mitchell | E02D 35/005 405/230 |
| 8,864,421 | B2 | | 10/2014 | Asplin | |
| 9,090,515 | B2 | | 7/2015 | Taveme | |
| 9,422,735 | B1 | | 8/2016 | Asplin | |
| 9,725,917 | B2 | | 8/2017 | Huh | |
| 2005/0158128 | A1 | † | 7/2005 | Canteri | |
| 2005/0238442 | A1 | * | 10/2005 | Queen | E02D 27/48 405/230 |
| 2006/0117678 | A1 | | 6/2006 | Neighbours | |
| 2007/0251184 | A1 | | 11/2007 | Schumann | |
| 2012/0286223 | A1 | | 11/2012 | Vigil | |
| 2016/0326759 | A1 | | 11/2016 | Huh | |
| 2016/0362901 | A1 | * | 12/2016 | Tabatabai | E02D 37/00 |

FOREIGN PATENT DOCUMENTS

| | | |
|---|---|---|
| JP | 2002-146717 | 5/2002 |
| WO | 2013113996 | 8/2013 |

OTHER PUBLICATIONS

U.S. Appl. No. 10/649,421, filed Aug. 26, 2003 (35 pages).

Jevin Thomas George et al., Design & Fabrication of Concrete Slab Lifting Device, pp. 181-185, vol. 3, Issue 11, Apr. 2017, International Journal for Innovative Research in Science & Technology.†

* cited by examiner
† cited by third party

WALL LIFTING METHODS

FIELD

This disclosure relates to methods of lifting structures such as foundation walls of buildings. The structures can be structures that have settled below a desired level and need to be lifted and thereafter maintained at a desired height. In addition, some structures can optionally be shifted laterally as well as being lifted.

BACKGROUND

In some circumstances it is necessary to apply a force to a structure to move the structure in a desired direction. For example, over time structures such as roadways, driveways, houses or portions thereof garage floors, porches, sidewalks, patios, etc., have a tendency to settle or sink and need to be raised upwardly to return the structure to its original level, U.S. Pat. Nos. 8,092,116, 8,186,907, 8,864,421, and 9,422,735 describe various techniques of lifting and raising structures.

SUMMARY

Methods of lifting structures such as a wall of a building are described. The wall can be any wall of a building where at least a portion of the wall is or will be below grade (i.e. some or all of the wall is below the surface of the ground). In one non-limiting example, the wall is a foundation wall of a building with a vertical wall portion and a footing at the base of the vertical wall portion. The wall can be lifted for any desired reason, including but not limited to lifting the wall because the waft has settled and needs to be raised and maintained at a desired height.

In the methods described herein, a fluid that is under pressure is injected beneath the base of the wall. The pressure of the injected fluid acts against the base of the wall to lift the wall vertically. In some embodiments, a supplemental lifting force mechanism can be attached to the wall to apply a supplemental lifting force to the waft that acts together with the lifting force applied by the injected fluid. The supplemental lifting force "lightens" the wall, reducing the amount of lifting force required to be applied to the wall by the injected fluid.

The injected fluid can be any material(s) suitable for lifting the wall and filling in spaces or voids underneath the wall when the wall is lifted. In one embodiment, the injected fluid can be a grout or slurry commonly used in mudjacking (also known as slabjacking), such as a mixture of water, cement and/or crushed limestone, or a foam material such as polyurethane foam. In another embodiment, the injected fluid can be pressurized air mixed with dried sand which fills any voids while the pressurized air lifts the wall.

DRAWINGS

DETAILED DESCRIPTION

Figure 1:
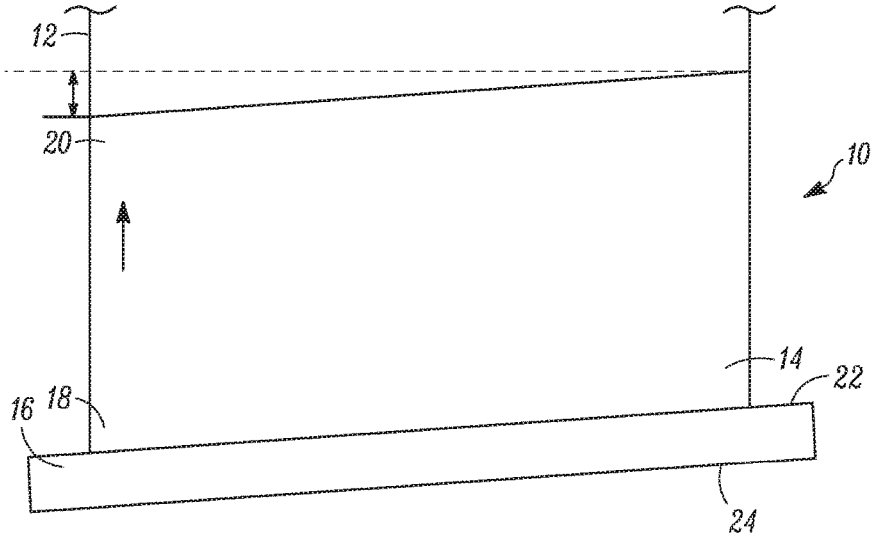
FIG. 1 is a side view of a wall that has settled and needs to be lifted using the techniques described herein.

FIG. 1 is a side view of an example of a structure that can be lifted. In this example, the structure is a foundation wall 10 of a building 12 disposed above and supported by the foundation wall 10 (only a portion of the building 12 is illustrated). In this example, the foundation wall 10 is therefore load bearing by supporting the building 12. However, the foundation wall 10 can be non-load bearing (i.e. a building has not yet been constructed above the foundation wall 10) for example during construction of the building where the foundation wall 10 may have settled and needs to be raised prior to construction of the building on the foundation wall 10. The foundation wall 10 is typically made of concrete.

Figure 3:
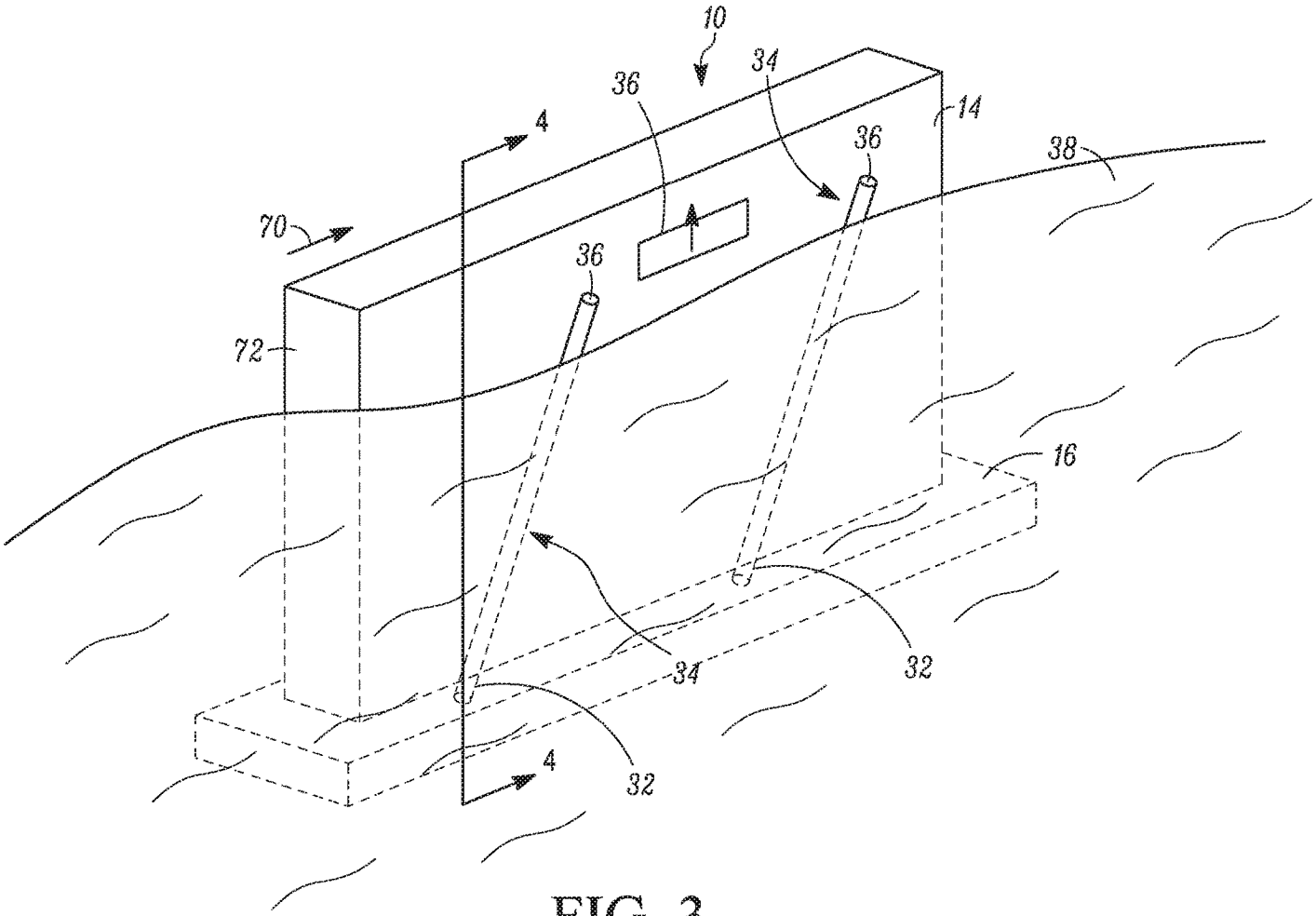
FIG. 3 is a perspective view of a wall with injection nozzles installed for lifting the wall.

The foundation wall 10 includes a vertical wall portion 14 and a footing 16 at a base 18 of the vertical wall portion 14. The vertical wall portion 14 and the footing 16 can be an integrally formed, one-piece or unitary construction, or the vertical wall portion 14 and the footing 16 can be separate pieces that are secured to one another. The general construction of a foundation wall with a vertical wall portion and a footing is well known in the art. The vertical wall portion 14 includes an upper end 20 opposite the base end 18. The footing 16 includes a top surface 22 that is attached to the base 18, and a bottom surface or base 24. As shown in FIG. 1, the footing 16 is longer than the vertical wall portion 14, and as shown in FIG. 3, the footing 16 has a width that is greater than the width of the vertical wall portion 14. Therefore, the footing 16 forms a stable base for the vertical wall portion 14.

Figure 2:
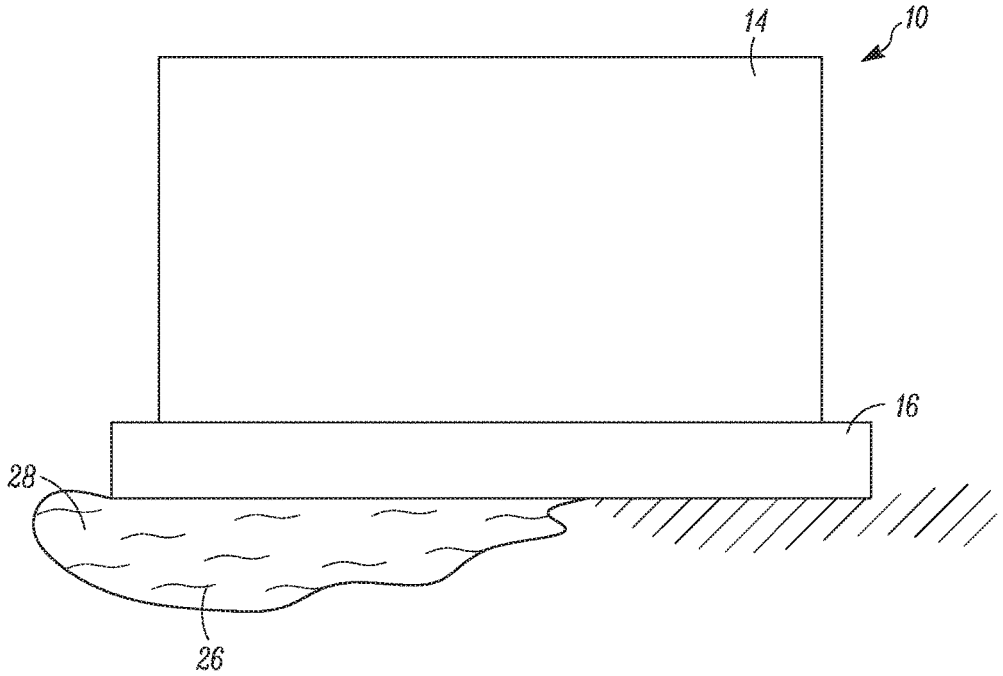
FIG. 2 is a side view of the wall of FIG. 1 after it has been lifted.

FIG. 1 shows that the left side portion of the foundation wall 10 has settled a distance X below its intended level position shown by the broken line. Therefore, the foundation wall 10 needs to be lifted vertically upward the distance X, and once lifted any void(s) underneath the footing 16 needs to be backfilled with material to prevent the foundation wall 10 from again settling. FIG. 2 shows the foundation wall 10 after it has been lifted vertically upward, and a void 26 underneath the footing 16 that is created when the foundation wall 10 is lifted has been filled (or substantially filled) with suitable fill material 28 which prevents the foundation wall 10 from resettling.

Figure 4:
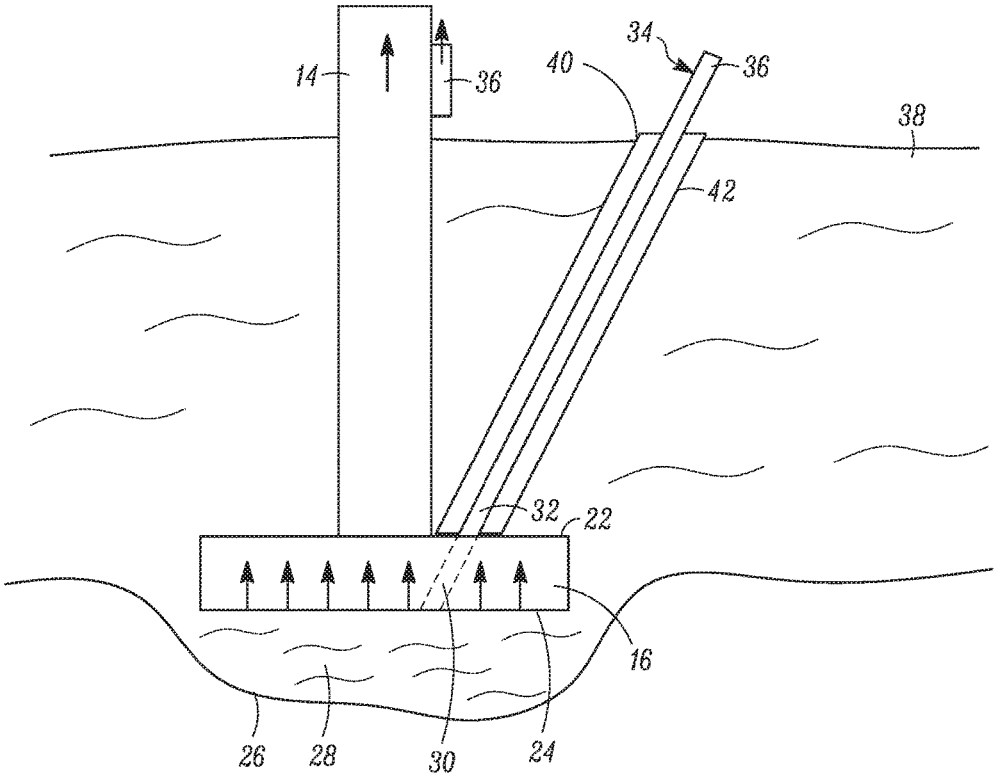
FIG. 4 is a cross-sectional end view of the wall taken alone line 4-4 of FIG. 3.
Figure 5:
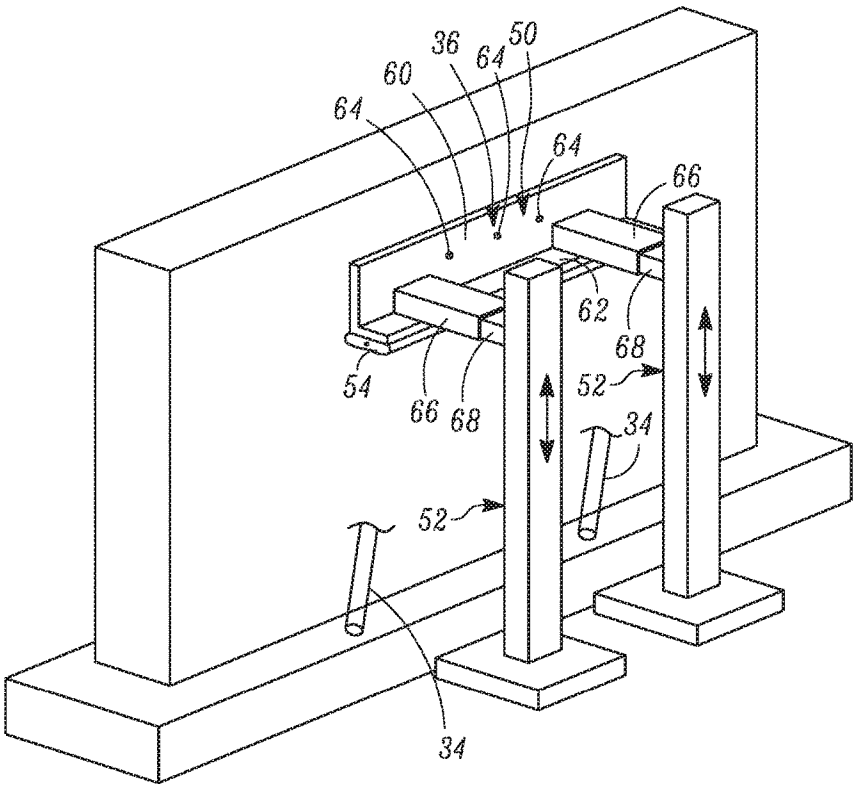
FIG. 5 is a perspective view of a wall showing an example embodiment of a supplemental lifting force mechanism.

Referring to FIGS. 3-5, one technique for vertically lifting the foundation wall 10 is illustrated. In general, at least one hole 30 is formed through the footing 16 from the top surface 22 to the base 24 thereof. An end 32 of a fluid injection nozzle 34 is then secured to the hole 30. A supplemental lifting force mechanism 36 is then used to apply a supplemental lifting force to the vertical wall portion 14. While the supplemental lifting force is applied to the vertical wall portion 14, a fluid under pressure is injected through the fluid injection nozzle 34 and underneath the footing 16. The fluid is injected at a pressure that is sufficient for the fluid to act against the base 24 of the footing 16 and thereby create a lifting force to vertically lift the foundation wall 10.

Any number of the holes 30 can be formed through the footing 16. FIG. 3 illustrates two of the holes 30 formed through the footing 16 and two of the fluid injection nozzles 34. However, in some embodiments, a single hole 30 or more than two of the holes 30 could be used. The hole(s) 30 is drilled through the footing at an angle from near the juncture with the vertical wall portion 14 to approximately the center of the base 24. If more than one hole 30 is formed, the holes 30 can be located a predetermined distance apart from one another, for example about 3 feet apart. For convenience, the holes 30 would typically be drilled on the same side of the vertical wall portion 14 although in some embodiments they could be disposed on opposite sides of the vertical wall portion 14.

The fluid injection nozzles 34 are elongated tubular structures that can be secured to and form generally fluid tight seals with the holes 30 so that the fluid under pressure can be injected through the nozzles 34 and into and through the holes 30 underneath the base 24 of the footing 16 without the fluid substantially leaking from between the end 32 of the nozzles 34 and the holes 30. In one embodiment, the nozzles 34 can be elongated metal pipes that extend from the holes 30 to an opposite end 36 disposed above grade (i.e. above soil 38 that the foundation wall 10 is disposed in) as seen in FIGS. 3 and 4. The ends 32 of the nozzles 34 can be threaded, and the ends 32 (or the entire nozzle 34) can have a diameter that is slightly less than the diameter of the holes 30. Thus, the ends 32 of the nozzles 34 can therefore be inserted into the holes 30 and the nozzles 34 rotated so that the threads thereof engage with the holes 30 to secure the ends 32 to the footings 16 and seal the ends 32 with the holes 30. The nozzles 34 are not limited to metal pipes and plastic pipes could be used. In addition, mechanisms other than threads for attaching and sealing the ends 32 of the nozzles 34 with the holes 30 could be used.

As shown in FIGS. 3-4, in some embodiments, the foundation wall 10 may be located in soil 38. Therefore, a hole(s) 40 needs to be bored through the soil 38 down to the top surface 22 of the footing 16. A soil auger, which is known in the art, can be used to bore the holes. Once the hole(s) 40 is bored, the nozzle(s) 34 can then be inserted into the bored hole(s) 40 down to the footing 16. The bored hole(s) 40 have a diameter that is larger than the diameter of the nozzle(s) 34. In some embodiments, for example if the lifting of the foundation wall 10 is to be done in stages or if it is believed that additional lifting may be necessary at a later date, a tube 42 can be inserted into the bored hole(s) 40 to line the bored hole and to maintain the hole 40. For example, a plastic tube can be inserted into each hole 40. The nozzle 34 can then be left in the tube 42 after lifting the foundation wall 10 or the nozzle 34 can be removed, and the tube 42 can be closed off by a cap (not shown). When additional lifting is desired, the cap can be removed, and the nozzle(s) 34 can be reinstalled through the tube 42 and into the hole(s) 30. If the tube 42 is no longer needed, the tube 42 can be removed and the hole 40 filled in with soil or other material.

The fluid that is injected under pressure can be any material that is sufficient to act against the base 24 of the footing 16 and thereby create a lifting force to vertically lift the foundation wall 10, as well as fill the void 26 that is left behind when the foundation wall 10 is lifted. In one embodiment, the injected fluid can be a grout or slurry commonly used in mudjacking (also known as slabjacking), such as a mixture of water, cement and/or crushed limestone. In another embodiment, the injected fluid can be a foam material (or one or more fluids that generate a foam material) such as polyurethane foam. In still another embodiment, the injected fluid can be pressurized air mixed with dried sand which fills any voids while the pressurized air lifts the wall. An example of the use of pressurized air and dried sand to lift objects and fill voids are disclosed in U.S. Pat. No. 8,186,907 which is incorporated herein by reference in its entirety.

With continued reference to FIGS. 3-5, lifting of the foundation wall 10 can be aided by the supplemental lifting force mechanism 36 which applies a supplemental lifting force to the vertical wall portion 14. The supplemental lifting force mechanism 36 can be located anywhere as long as it can apply a supplemental lifting force to the vertical wall portion 14 that is in addition to any lifting force applied by the fluid injected under pressure through the nozzle(s) 34. In one embodiment, the supplemental lifting force mechanism 36 is attached to the vertical wall portion 14 approximately in line with the center of the lifting force applied to the footing 16 by the injected fluid under pressure. For example, as shown in FIGS. 3 and 5, the supplemental lifting force mechanism 36 can be located between the two nozzles 34. In one embodiment, the supplemental lifting force mechanism 36 can be secured to a portion of the vertical wall portion 14 that is disposed above grade as shown in FIGS. 3-4. However, in other embodiments, some of the soil around the vertical wall portion 14 can be dug out in order to attach the supplemental lifting force mechanism to the vertical wall portion 14 effectively below grade.

The supplemental lifting force mechanism 36 can have any construction that is suitable for applying the supplemental lifting force. FIG. 5 illustrates details of one example of the supplemental lifting force mechanism 36. In this example, the supplemental lifting force mechanism 36 includes a bracket 50, a pair of lifting jacks 52, and an inflatable hose 54.

The bracket 50 is an L-shaped structure with a vertical portion 60 and a horizontal portion 62. The vertical portion 60 is fixed to the vertical wall portion 14, for example by a plurality of bolts 64. Once the vertical portion 60 is fixed to the vertical wall portion 14, the horizontal portion 62 projects substantially horizontally outwardly from the vertical wall portion 14. The bracket 50 also includes a pair of hollow sleeves 66 projecting horizontally outwardly therefrom near the ends of the bracket 50. In one embodiment, the sleeves 66 are fixed at their ends to the vertical portion 60 and along their bottoms to the horizontal portion 62. In use, the sleeves 66 receive lifting arms 68 that are part of the lifting jacks 52.

The lifting jacks 52 are mechanical structures that can be vertically extended and retracted, thereby raising and lowering the lifting arms 68. The lifting jacks 52 can be manually or automatically actuated using a mechanical mechanism such as a screw jack, hydraulically operated, or pneumatically operated. In operation, the lifting arms 68 of the jacks 52 are disposed in the sleeves 66 and when the jacks 52 are extended, the lifting arms 68 are raised thereby applying a lifting force to the vertical wall portion 14 via the bracket 50. Once the supplemental lifting force is no longer required, the jacks 52 can be retracted which lowers the lifting arms 68 and removes the supplemental lifting force. The use of jacks to lift a structure is disclosed in U.S. Pat. No. 5,860,763.

Figure 8:
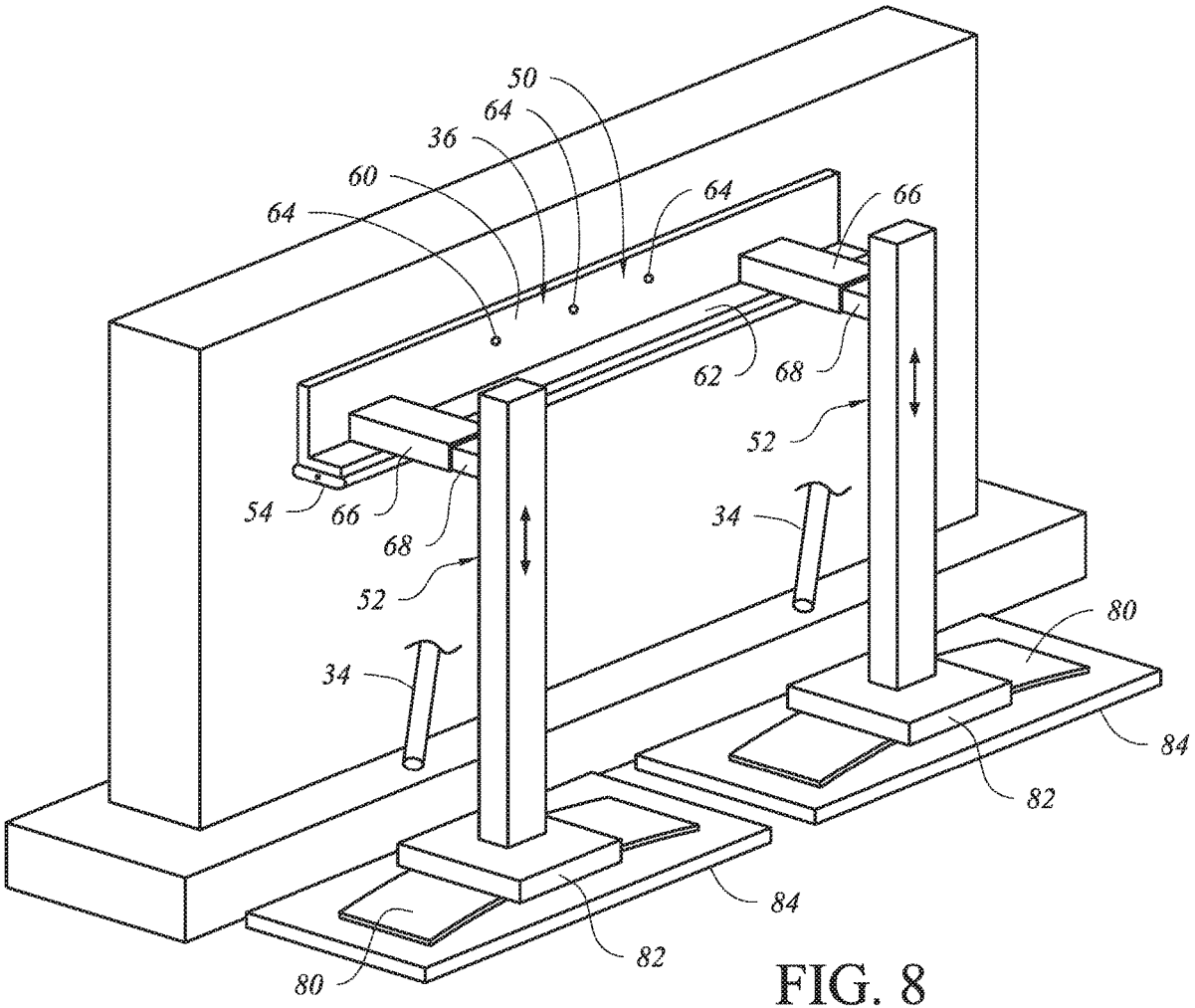
FIG. 8 is a perspective view of a portion of a wall showing springs placed underneath the lifting jacks.

FIG. 8 illustrates a variation that is similar to FIG. 5, but showing a spring 80 placed underneath each one of the lifting jacks 52 to apply an upward bias force on the lifting jacks 52. The spring 80 provides a continuous lift force extending the range of the lifting jack 52 without operator intervention. In this embodiment, the spring 80 is located underneath and engaged with a base plate 82 of each one of the lifting jacks 52, and a mat 84 is located underneath the springs 80 to prevent the springs 80 from sinking into the ground during lifting. The springs 80 can be any type of springs and can have any configuration suitable for applying the continuous lifting force on the lifting jacks 52. In the illustrated example, the springs 80 are leaf springs.

The inflatable hose 54 can be used instead of, or in addition to, the lifting jacks 52. The inflatable hose 54 is located underneath the horizontal portion 62 and disposed on the soil 38 or on other solid structure next to the vertical wall portion 14. The inflatable hose 54 is initially placed in position in a deflated condition. When the hose 54 is inflated, the hose 54 acts against the horizontal portion 62 and pushed the horizontal portion 62 upwardly to create the supplemental lifting force. Examples of using inflatable hoses to lift structures are disclosed in U.S. Pat. Nos. 8,092,116, 8,864,421, and 9,422,735.

In addition to lifting the foundation wall 10, in some embodiments it may also be possible to laterally displace the foundation wall 10. For example, referring to FIG. 3, when the foundation wall 10 is lifted vertically upward, a lateral force 70 can also be applied to the foundation wall 10. The lateral force 70 can be applied using any suitable mechanism, for example a hose(s) or jack(s) that engages an end 72 of the wall 10. The lateral force 70 is sufficient to laterally shift the wall 10 for example closer to another foundation wall or closer to another section of the wall 10.

Figure 6:
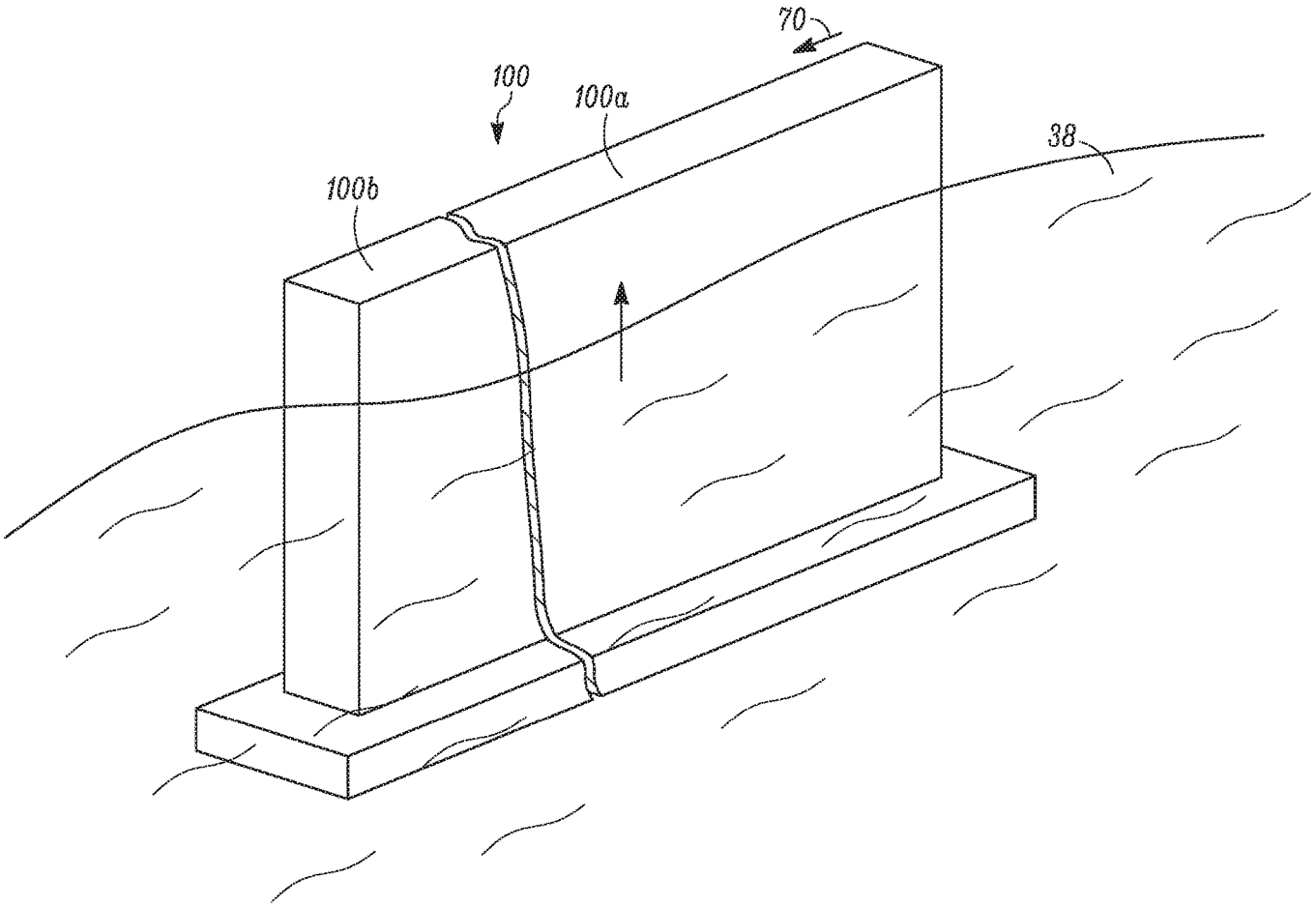
FIG. 6 is a perspective view of another example of a wall that needs to be lifted.

FIG. 6 illustrates an embodiment of a foundation wall 100 that has a construction similar to the foundation wall 10. The foundation wall 100 is shown as being split into two sections 100*a*, 100*b*, one or both of which have settled and need to be raised vertically. The lifting techniques described above with respect to FIGS. 3-5 can be used to lift one or both of the sections 100*a*, 100*b*. In addition, the lateral force 70 can be applied to one or both of the wall sections 100*a*, 100*b* in order to laterally shift the wall sections 100*a*, 100*b* toward one another.

Figure 7:
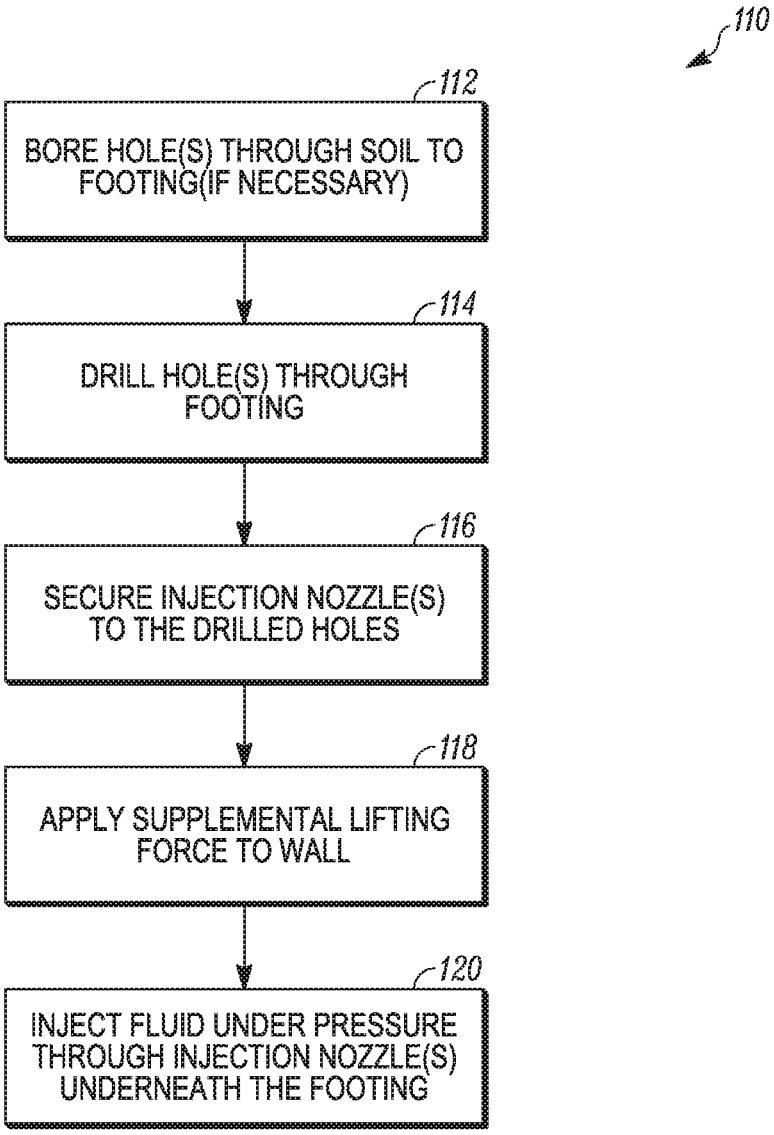
FIG. 7 illustrates one embodiment of a lifting method described herein.

FIG. 7 illustrates an example lifting method 110 described herein. The method 110 includes an optional initial step 112 of boring the hole(s) in the soil down to the footing of the foundation wall. If the foundation wall is not disposed in soil, the hole boring is not required, and the hole(s) can be drilled through the footing in step 114. Once the hole(s) is drilled, the injection nozzle(s) is then secured to the hole(s) in step 116. A supplemental lifting force is then applied to the foundation wall in step 118, and while the supplemental lifting force is being applied to the wall, fluid under pressure is injected through the injection nozzle(s) underneath the footing in step 120. The supplemental lifting force together with the force of the injected fluid acting against the base of the footing is sufficient to lift the foundation wall vertically to the desired height. The injected fluid also fills in any voids underneath the footing. Once the desired lift height is achieved, the fluid injection through the injection nozzle(s) and the application of the supplemental lifting force are stopped. If it is determined that additional lifting is necessary, the process can be repeated.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of lifting a foundation wall that includes a vertical wall portion and a footing at a base of the vertical wall portion, the method comprising:

forming at least one hole through the footing from a top surface thereof to a base thereof;

securing an end of a fluid injection nozzle to the at least one hole;

applying a supplemental lifting force to the vertical wall portion using a supplemental lifting force mechanism; and while the supplemental lifting force is applied to the vertical wall portion, injecting a fluid under pressure through the fluid injection nozzle and underneath the footing, the fluid being injected at a pressure that is sufficient for the fluid to act against the base of the footing and thereby create a lifting force to vertically lift the foundation wall;

wherein the fluid injection nozzle and the supplemental lifting mechanism do not extend below the base of the footing.

2. The method of claim 1, wherein the fluid comprises mudjacking grout, a foam material, or pressurized air mixed with dried sand.

3. The method of claim 1, wherein the footing and at least a portion of the vertical wall portion are below grade in soil, and further comprising:

prior to forming the at least one hole through the footing, boring a hole in the soil to the top surface of the footing to create a bored hole in the soil;

thereafter forming the at least one hole in the footing utilizing a drill that extends through the bored hole; and inserting the fluid injection nozzle through the bored hole to secure the end to the at least one hole.

4. The method of claim 3, further comprising installing a tube into the bored hole to line the bored hole.

5. The method of claim 3, further comprising securing the supplemental lifting force mechanism to a portion of the vertical wall portion that is disposed above grade, and applying the supplemental force using the supplemental lifting force mechanism.

6. The method of claim 1, further comprising:

when the foundation wall is lifted, applying a lateral force to the foundation wall to shift the foundation wall laterally.

7. The method of claim 1, comprising:

forming a plurality of the holes through the footing from the top surface thereof to the base thereof;

securing ends of a plurality of fluid injection nozzles to the plurality of holes;

applying the supplemental lifting force to the vertical wall portion using the supplemental lifting force mechanism; and while the supplemental lifting force is applied to the vertical wall portion, injecting a fluid under pressure through the fluid injection nozzles and underneath the footing, the fluid being injected at a pressure that is sufficient for the fluid to act against the base of the footing and thereby create a lifting force to vertically lift the foundation wall.

8. The method of claim 7, wherein the holes are laterally spaced from one another along a section of the footing.

9. The method of claim 1, further comprising arranging a spring underneath the supplemental lifting force mechanism to thereby apply a continuous lifting force to the supplemental lifting force mechanism.

10. The method of claim 1, comprising forming the at least one hole through the footing at an acute angle from the top surface thereof to the base thereof, the at least one hole exiting the base approximate a center of the base; and the injected fluid acts against the base over an extent such that the lifting force is spread out on opposite sides of the center of the base.

* * * * *